US005845333A

United States Patent [19]

Crampton

[11] Patent Number: 5,845,333

[45] Date of Patent: Dec. 8, 1998

[54] KNEE PADS FOR WORK PANTS

[75] Inventor: Richard H. Crampton, Gresham, Oreg.

[73] Assignee: Working Concepts, Inc., Portland, Oreg.

[21] Appl. No.: 74,555

[22] Filed: May 7, 1998

[51] Int. Cl.[6] ..... A41D 13/06; A41D 37/00

[52] U.S. Cl. ..... 2/24; 2/247; 2/243.1

[58] Field of Search ..... 2/455, 456, 463, 2/465, 2.5, 22, 23, 24, 46, 267, 268, 247, 248, 249, 250, 251, 252, 253, 243.1

[56] References Cited

U.S. PATENT DOCUMENTS 4,756,026 7/1988 Pierce, Jr. ..... 2/24

4,831,666 5/1989 Denman ..... 2/23

4,920,577 5/1990 Scharf ..... 2/24

5,210,881 5/1993 Stocker et al. ..... 2/247

5,603,653 2/1997 Hartman ..... 2/53

*Primary Examiner*—Jeanette Chapman

*Attorney, Agent, or Firm*—Smith-Hill and Bedell

[57] ABSTRACT

A resilient, flat closed-cell knee pad is rolled and inserted through a gap in a seam attaching edges of a patch to the knee area of a work pant. The knee pad then unrolls and fills a space between the work pant and the patch thereby protecting a wearer's knee when kneeling.

6 Claims, 1 Drawing Sheet

KNEE PADS FOR WORK PANTS

BACKGROUND OF THE INVENTION

The present invention relates in general to a pad for protecting worker's knees and shins and in particular to a knee pad that can be inserted into the knee pockets of ready-made pants and held there without straps.

DESCRIPTION OF RELATED ART

When you kneel on a flat surface much of your weight is borne by small areas of the knees, and you subject those areas to high pressure. Such pressure can damage your knees if you spend long periods in the kneeling position. Knee pads can protect your knees by distributing your weight over wider areas. They also help protect your knees from bumps.

Despite the protection that knee and shin pads provide, many worker's don't use them. Conventional knee and shin pads are uncomfortable in part because they must be strapped to the user's leg as taught, for example, in U.S. Pat. No. 1,172,552 issued Feb. 22, 1916 to Pierce; U.S. Pat. No. 5,297,294 issued Mar. 29, 1994 to Washick; U.S. Pat. No. 4,876,475 issued Oct. 31, 1989 to Richards; and U.S. Design Pat. No. 278,470 issued Apr. 23, 1985 to Eghamn. Whether you strap a pad to your leg outside or inside your pant leg, the straps must hold the pad snugly to your leg to keep it in place. The straps or constricted pant legs are irritating and can reduce air flow around your legs. The straps can also reduce blood circulation in your leg.

U.S. Pat. No. 4,920,577 issued May 1, 1990 to Scharf describes work pants with inverted pockets over the knees securing removable knee pads. Since the pads are not held by straps, air is free to circulate between the pant legs and the wearer's knees when the wearer is not kneeling. Since the pads can get wet and would be difficult to dry inside a pocket, an opening is provided at the lower edge of each pocket to allow the wearer to remove the pads from the pockets and dry them. The pocket openings include opposed strips of hook and loop material ("Velcro") so that after the user reinserts the dry pads back into the pockets, he can seal the openings. The openings are placed at the bottom of the pocket to provide a drain path for any water accumulating in the pocket. Unfortunately the Velcro fasteners add expense to the cost of the pant and may wear out or get damaged.

Popular work pants now on the market include a rectangular patch of material over the knee area of each pant leg to protect the pant leg from wear. All four edges of each patch are sewn to the pant legs but the seam along the lower edge of each patch includes a small gap to allow water and dirt to drain from the space between the pant leg and the patch. These work pants could be adapted to hold knee pads as taught by Scharf, but not easily. The seam along the lower edge of each knee patch would have to be removed and Velcro material would have to be sewn to the patch and pant leg to allow the opening to be sealed after a knee pad is installed in the space between the pant leg and the patch.

What is needed is a system for easily installing knee pads in work pants of the type having knee patches sewn on all four sides.

SUMMARY OF THE INVENTION

The manufacturer of a popular work pant now on the market sews a rectangular patch over the knee area of each pant leg to protect the knee area from wear, thereby extending the life of the work pants. The manufacturer sews all four edges of each patch to the pant leg, but leaves a small gap in the stitching along the lower edge of each patch to allow water and dirt to fall out when it accumulates in the space between the patch and the pant leg.

In accordance with the present invention a molded, rectangular, closed-cell foam pad is rolled up and inserted through the gap in the stitching into the space between the pant leg and the knee patch. The pad then uncoils and assumes its original shape filling the space between the patch and the pant leg. Since the pad is much wider than the opening at the bottom of the patch, the pad is permanently affixed to the pants and cannot fall out of the space between the patch and the pant leg. Thus it is not necessary to provide any fastener for closing the gap. Also since the pads are made of closed-cell foam material, they do not absorb water and therefore do not need to be removed for washing and drying.

It is accordingly an object of the invention to provide a method for easily retro-fitting ready made work pants having knee patches sewn thereon with comfortable knee pads that will protect the wearer's knees.

It is another object of the invention to provide a work pant with a permanent, integral knee pad that need not be removed for washing and drying.

The concluding portion of this specification particularly points out and distinctly claims the subject matter of the present invention. However those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENT(S)

Figure 1:
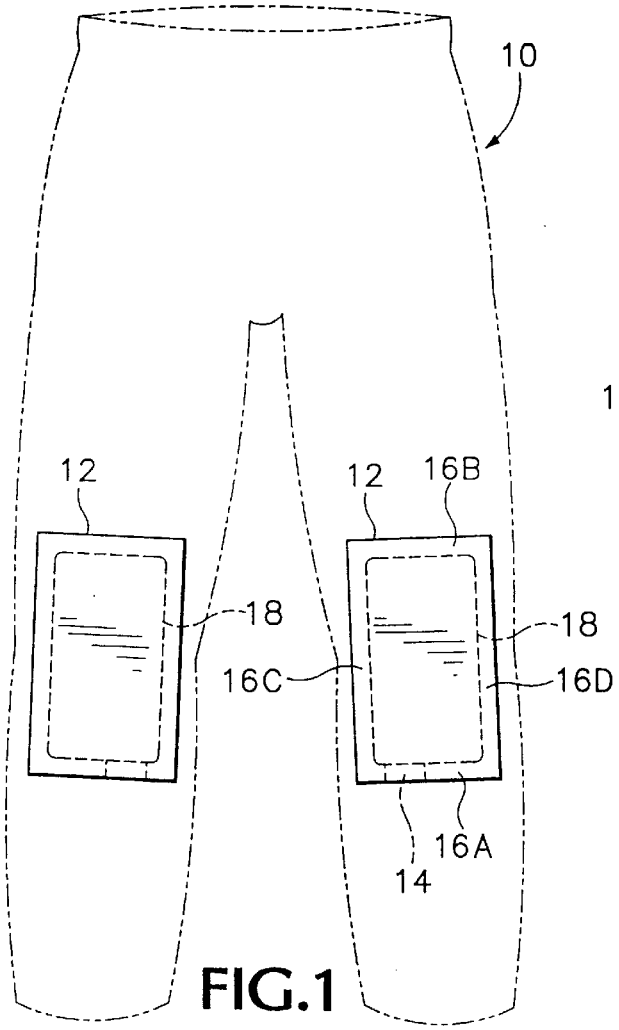
FIG. 1 is a pictorial view of a prior art ready made work pant having patches over its knee areas.

FIG. 1 illustrates a pair of prior art work pants 10 having rectangular fabric patches 12 sewn over the knees and upper shin portions of the pant legs. Pants 10 are widely used by people who kneel frequently because the fabric forming patches 12 helps protect the underlying knee area of pants 10 from wear. Seams 16A–16D along all four edges of each patch 12 attach the patch to pants 10. A small gap 14 in the seam 16A along the lower edge of each patch 12 provides a "wash hole" through which water can drain from a space between patch 12 and pant 10.

Figure 2:
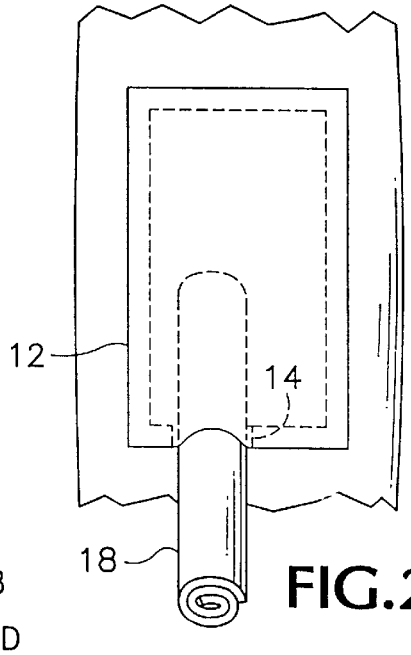
FIG. 2 illustrates a method of installing knee pads into spaces between the patches and the knee areas of the work pant of FIG. 1 in accordance with the present invention.

In accordance with the present invention, as illustrated in FIG. 2, a resilient knee pad 18 is inserted into the space between each patch 12 and the underlying knee area of pant 10 by first rolling the pad so that it forms a tubular shape and then sliding it into the space between patch 12 and pant 10 via gap 14. If the gap 14 in the lower edge seam 16A of patch 12 is not quite wide enough to accommodate the rolled-up knee pad 18, gap 14 may be enlarged as needed by removing a short length of stitching in the edge 16A bounding gap 14. After entering the space between pant 10 and patch 12, pad

18 uncoils and resumes its original shape. Pad 18 is suitably sized to snugly fit the space between pant 10 and patch 12 when it uncoils therein. Pad 18 won't thereafter fall through gap 14 because when uncoiled pad 18 it is too wide to fit through gap 14. However if desired, gap 14 may be reduced or sealed with waterproof fabric glue.

Figure 3:
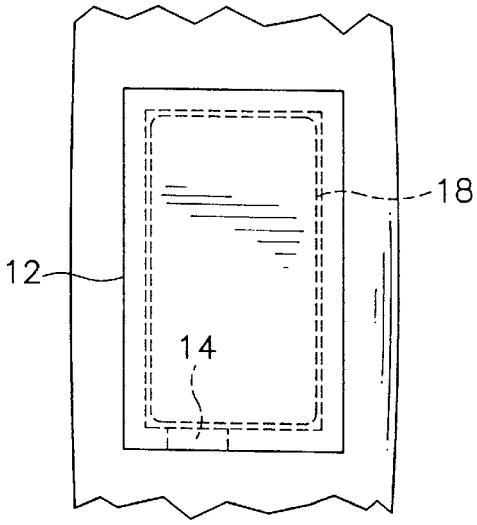
FIG. 3 is a plan view of a knee area of the work pant of FIG. 1 after a knee pad has been installed.
Figure 4:
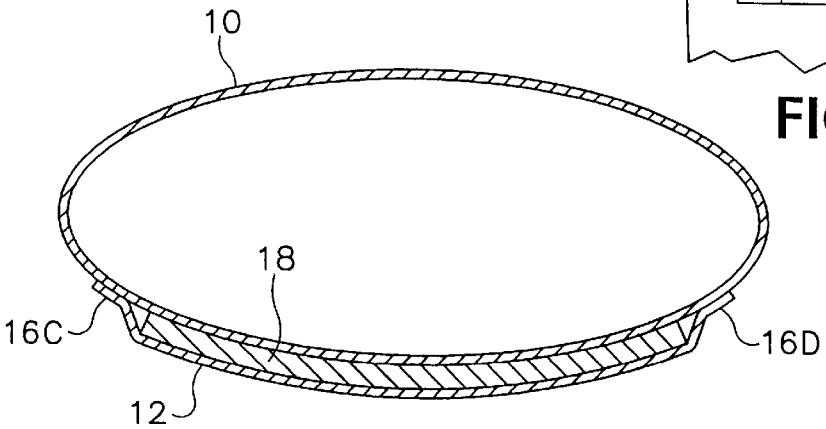
FIG. 4 is a sectional view of the work pant knee area of FIG. 3.

FIGS. 3 and 4 show plan and cross-sectional views of knee pads 18 in accordance with the present invention. The knee pad 18 is rectangular in shape and is sized to fit snugly within the space between patch 12 and work pants 10 so that it remains in place even with the gap 14 left open. The knee pads 18 are suitably made of resilient, closed-cell foam so that they do not absorb water and do not need to be removed for drying. The foam material provides the flexibility needed to roll into a tube for insertion into patch 12, and to conform to the curvature of the pant legs.

While the forgoing specification has described preferred embodiment(s) of the present invention, one skilled in the art may make many modifications to the preferred embodiment without departing from the invention in its broader aspects. The appended claims therefore are intended to cover all such modifications as fall within the true scope and spirit of the invention.

What is claimed is:

1. A method for making a knee pad on a pair of work pants pair having stitched seams attaching edges of a patch to a knee area of the work pant, one of said seams having a gap therein, the method comprising the steps of:

rolling a knee pad that is wider than said gap so that it is substantially tubular in shape, and inserting the rolled knee pad through said gap and into a space between said patch and said knee area, whereupon said knee pad unrolls itself within said space.

2. The method in accordance with claim 1 further comprising the step of gluing said gap shut after inserting the rolled knee pad.

3. The method in accordance with claim 1 wherein said knee pad comprises a resilient, water-proof material.

4. The method in accordance with claim 3 wherein said knee pad consists of closed-cell foam.

5. The method in accordance with claim 1 wherein said knee pad is sized to substantially fill said space.

6. The method in accordance with claim 1 further comprising the step of enlarging said gap before inserting the rolled knee pad through said gap.

* * * * *